US005624283A

United States Patent [19]

Hotea

[11] Patent Number: 5,624,283

[45] Date of Patent: Apr. 29, 1997

[54] ELECTRICAL TERMINAL BACK-UP SPRING WITH ANTI-CHATTERING SUPPORT MEMBERS

[75] Inventor: Gheorghe Hotea, Griesheim, Germany

[73] Assignee: The Whitaker Corporation, Wilmington, Del.

[21] Appl. No.: 411,005

[22] Filed: Mar. 27, 1995

[30] Foreign Application Priority Data

Apr. 7, 1994 [GB] United Kingdom ..... 9406934

[51] Int. Cl.[6] ..... H01R 13/434

[52] U.S. Cl. ..... 439/751; 439/745

[58] Field of Search ..... 439/745, 746, 439/751, 869, 873, 852, 733.1

[56] References Cited

U.S. PATENT DOCUMENTS

| | | | |
|---|---|---|---|
| 3,957,337 | 5/1976 | Damiano | 339/217 S |
| 4,083,022 | 4/1978 | Nijman | 333/79 |
| 4,139,255 | 2/1979 | Otani | 339/217 S |
| 4,385,794 | 5/1983 | Lucius | 439/401 |
| 4,900,271 | 2/1990 | Colleran et al. | 439/595 |
| 5,152,700 | 10/1992 | Bogursky et al. | 439/733 |
| 5,240,439 | 8/1993 | Egenolf | 439/745 |
| 5,266,056 | 11/1993 | Baderschneider et al. | 439/746 |

FOREIGN PATENT DOCUMENTS

| | | |
|---|---|---|
| 0492479A2 | 12/1991 | European Pat. Off. . |
| 0517139A3 | 6/1992 | European Pat. Off. . |
| WO90/03670 | 4/1990 | WIPO . |

*Primary Examiner*—Gary F. Paumen
*Assistant Examiner*—T. C. Patel
*Attorney, Agent, or Firm*—Driscoll A. Nina, Jr.

[57] ABSTRACT

An electrical terminal comprises an inner contact body and an outer spring body. The outer spring body is box-shaped and encloses the inner contact body. The outer spring body comprises spring beams edge-stamped out of top and bottom walls respectively. Protrusions are positioned centrally along the spring beams, and project beyond side walls of the outer spring body such that when the terminal is inserted into a corresponding housing cavity, the protrusions interfere with walls thereof. The spring beams are thus resiliently biased and the terminal is resiliently held within the housing cavity such that chattering of the terminal therein is prevented. Vibration movements parallel to the top and bottom walls causes the spring beams to act in the plane of the metal, and vibration movements perpendicular thereto cause the spring beams to act in torsion. Due to the edge-stamping of the spring beams out of top and bottom walls, they are very simple to manufacture, yet very effective, robust and reliable.

8 Claims, 2 Drawing Sheets

ELECTRICAL TERMINAL BACK-UP SPRING WITH ANTI-CHATTERING SUPPORT MEMBERS

BACKGROUND OF THE INVENTION

1. Field of the Invention

This invention relates to provision of spring support members on an electrical terminal, to reduce vibration of the terminal within a corresponding electrical connector housing cavity.

2. Description of the Prior Art

Electrical connectors subjected to vibration, for example electrical connectors in an automobile, may fail due to fretting corrosion. The vibrations can cause relative micro-movements between mating contacts which is the cause of fretting corrosion. In order to reduce relative movements between mating contacts, it is known to provide terminals with inner contact bodies having supple longitudinal spring sections between the contact section and the conductor connection section of the terminal. The longitudinal spring thus decouples the contact section from the rest of the connector and allows it to float freely with the mating contact such that no micro-movements therebetween occur. An example of such a receptacle terminal is described in European patent application 492479.

It is common to provide an outer spring body to the inner contact bodies, the outer spring bodies comprising a stronger and more resilient material that the inner contact body. The outer spring body may serve a number of purposes, for example providing resilient locking lances for retention of the terminal in a cavity housing, or for outer protection of the inner contact, or for having spring arms to increase the contact spring force of the inner contact body contact arms. Outer spring bodies are also very useful when the inner contact body has a supple longitudinal spring for allowing floating movement of the contact section. The contact section must be prevented from rubbing against the housing cavity walls, but also must be protected due to the supple spring which can be easily damaged by stubbing of the complementary terminal against the contact section.

One of the problems of prior art terminals is that there is a certain amount of play between the terminal and the housing cavity in order to allow insertion of the terminal therein, which under vibratory conditions causes chattering of the terminal within the cavity. Chattering can be the source of large inertial forces which may causing relative movements between mating contacts, whether they are endowed with longitudinal resilient springs or not.

It would therefore be desirable to reduce chattering of terminals within housing cavities.

SUMMARY OF THE INVENTION

It is therefore an object of this invention to provide an electrical terminal with means to reduce chattering thereof within a corresponding connector housing cavity.

It is a further object of this invention to provide an electrical terminal with anti-chattering support members, that is cost-effective yet reliable.

The objects of this invention have been achieved by providing an electrical terminal comprising an inner contact body having contacts thereon for mating with a complementary contact, and body section having support members comprising a protrusion for abutment against a housing cavity wall, wherein the protrusion is mounted on a spring beam stamped out of the body section. For terminals with outer back-up springs, the body section would advantageously be comprised in the outer back-up spring. A further advantageous embodiment would be in providing substantially planar spring beams stamped out of opposing walls of the body section.

DETAILED DESCRIPTION OF THE PREFERRED EMBODIMENT

Figure 1:
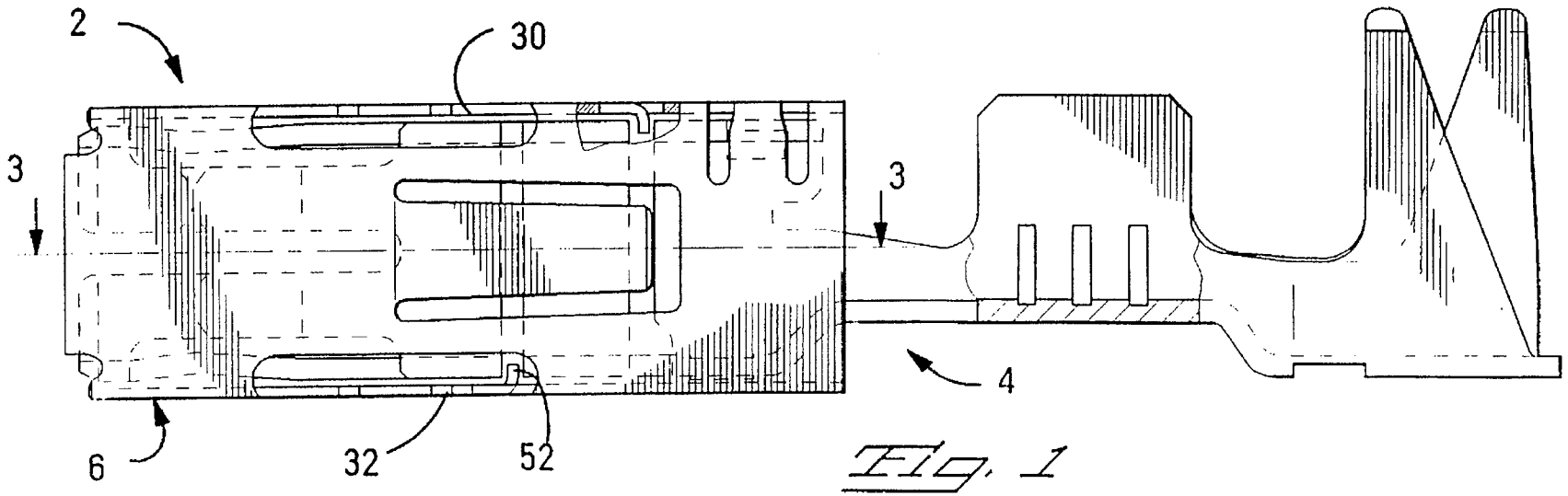
FIG. 1 is a side view of a terminal according to this invention.
Figure 2:
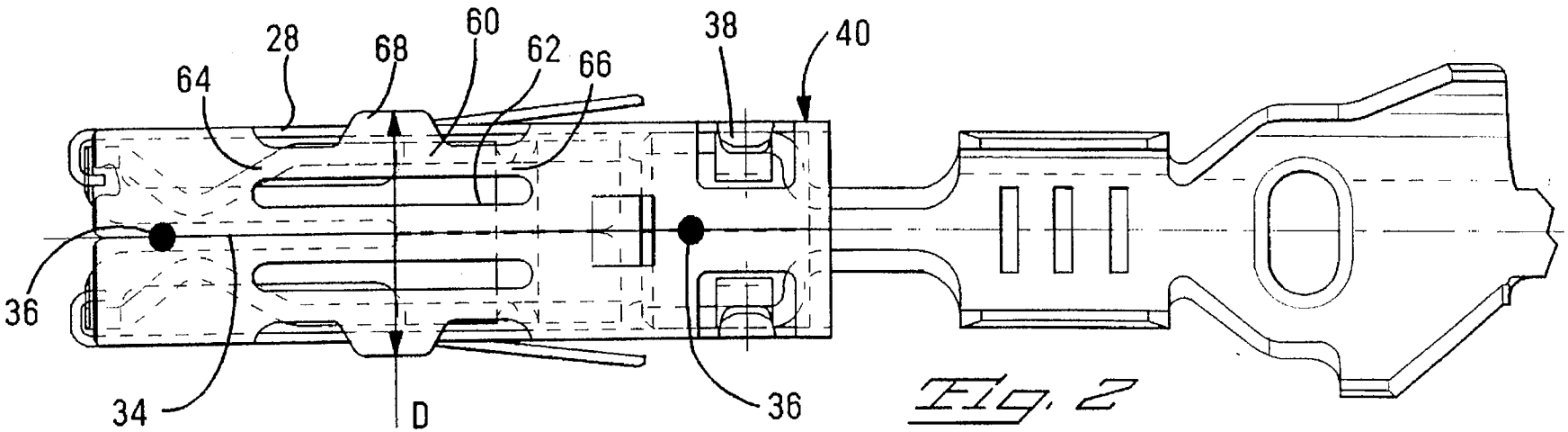
FIG. 2 is a view in the direction of arrow 2 of FIG. 1.
Figure 3:
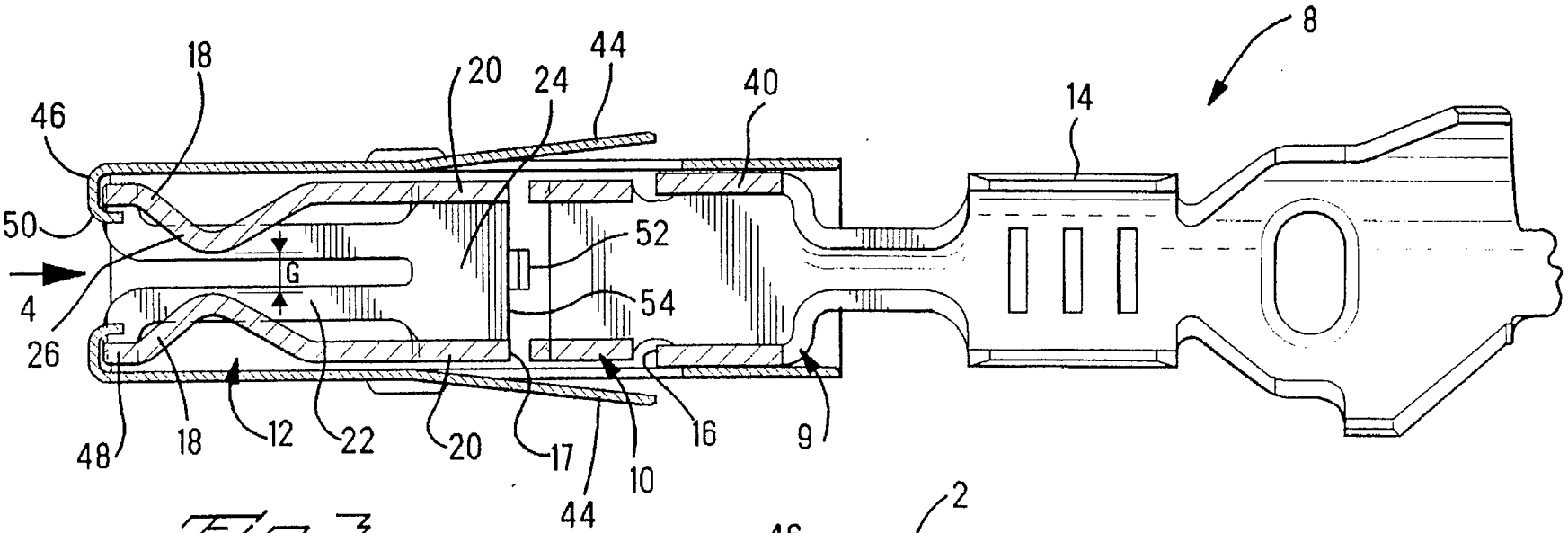
FIG. 3 is a cross-sectional view through lines 3—3 of FIG. 1.
Figure 4:
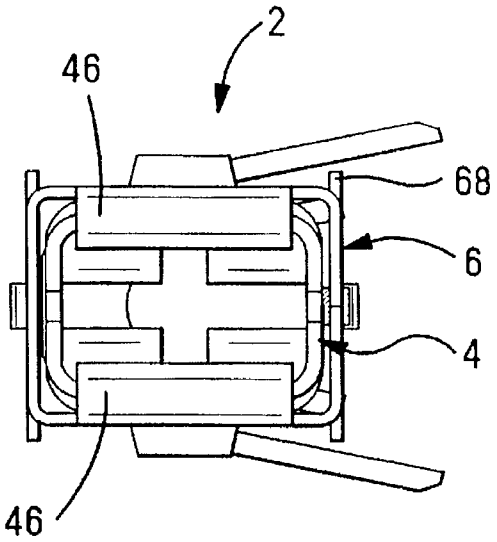
FIG. 4 is a view in the direction of arrow 4 of FIG. 3.

Referring to FIGS. 1–4, an electrical receptacle terminal 2 comprises an inner contact body 4 and an outer spring body 6. The inner contact body 4 comprises a wire connection section 8, a base section 9, a spring section 10 and a contact section 12 extending longitudinally therefrom. The connection section 8 is shown as comprising a crimping barrel 14 for crimping to bared conducting strands of an electrical wire conductor, but of course the connection section 8 could have any other conductor connection means. The spring section 10 is box-shaped and has transverse slots 16, 17 that enable the spring section to be very supple in the longitudinal direction in a manner similar to that shown in European patent application 492479.

The contact section 12 comprises pairs of opposed contact arms 18 extending from opposed side walls 20 that are attached to the forward end of the spring section. The other end of the contact arms 18 are joined to orthogonal wall support members 22 that are stamped out of opposed top and bottom walls 24 extending between lateral edges of the side walls 20. The contact arms 18 comprise opposite and inwardly bowed contact portions 26 for making contact with a complementary male tab inserted therebetween. The arcuate contact portions 26 are separated from each other by a gap G which serves two purposes: the first is to reduce the insertion force of a male tab therebetween (peak mating forces are encountered when initially separating opposed and touching contact beams apart); and secondly, although the spring forces are very high in this contact due to the combination of wall support members 22 and the contact arms 18, flexibility is reduced in comparison to free cantilever beam contacts, and the gap G therefore reduces the deflection of the contact section making this more rigid design feasible.

The outer spring body 6 is stamped and formed out of resilient sheet metal, such as stainless steel, into a box-shape. The box shape has opposed side walls 28 and extending orthogonally between lateral edges thereof, opposed top and bottom walls 30, 32 respectively. The top wall 30 comprises a longitudinal seam 34 resulting from the folding together of the box. The seam 34 is held closed by laser welds 36 that also increases the rigidity and strength of the box. The outer spring body further comprises clinching tabs 38 at a rear attachment end 40 of the outer spring body, the tabs 38 being tightly secured by clinching over edges of side walls 40 of the inner contact base section 9. The outer spring body 6 is thus securely held to the inner contact body 4 at the base section 9, proximate the connection section 8. The contact section 12 can thus float within the outer spring body. The outer spring body further comprises resilient locking lances 44 projecting out of the side walls 28 for securing the terminal 2 in a housing cavity therefor. At a mating end 46 of the spring body, the side walls 28 extend over ends 48 of the contact arms 18 in a U-shape. The folded-over U-shape extensions 50 serve a number of purposes, one of them being to protect the contact arms from being stubbed by a mating terminal i.e. protecting the inner contact body.

Due to the supple longitudinal spring section 10, the contact section 12 is limited from overstress in it's longitudinal movements: in a first direction by the U-shaped mating end tabs 50 of the outer spring body; and in the second direction by a stress limiting tab 52 which is stamped from the bottom wall 32 of the outer spring body into a transverse slot 17 of the spring section. The over-insertion tab 52 is positioned proximate a rear end 54 of the contact section 12 and prevents over-compression of the spring section 10 in particular during insertion of a tab between the contact arms 18. In order to prevent relative movements between the contacts 26 and mating tab, the frictional force therebetween must necessarily be greater than the spring force of the spring section 10, and therefore without the over-insertion tab 52 the spring would be completely compressed and may be damaged during the coupling with a complementary tab. During the first few cycles of vibration, the over-insertion tab 52 will eventually be positioned in the substantially central portion of the transverse slot 17 and the contact section will not abut this over-insertion tab.

In order to further reduce the risk of fretting corrosion between a mating tab and the contact section 12, it would also be advantageous to securely hold the outer spring body 6 within the corresponding housing cavity such that inertial forces due to chattering are reduced or eliminated. The outer spring body further comprises spring beams 60 that are stamped out of the plane of the top and bottom walls 30, 32 respectively, whereby a slot 62 separates the spring beams 60 from the wall such that the spring beam is attached to the wall at opposed longitudinal ends 64, 66. A protrusion 68 is positioned centrally on the spring beam between the ends 64, 66 and extends beyond the side wall 28. Opposing protrusions 68 in either the top or the bottom wall 30, 32 are separated by a distance D which is greater than the width of the housing cavity, such that during insertion of the terminal therein, the protrusions 68 interfere with the housing cavity walls and the spring beams 60 are resiliently biased inwards. The outer spring body is thus securely held within the housing cavity by a resilient spring force exerted by the spring beams 60, thereby reducing chattering of the terminal 2 within the housing cavity during vibrations.

Due to the spring beams 60 and protrusions 68 being edge-stamped out of the plane of either the top or bottom walls 30, 32, the spring beams are cost-effective to manufacture. are robust and provide a very effective and strong spring force. In movements perpendicular to the side walls 28 the spring beams act mainly in the plane of the sheet metal, and in movements perpendicular thereto, the spring beams act mainly in torsion. The geometrical dimensions of the slot 62 and spring beam 60 can easily be varied to have the optimal spring characteristics both in torsion and within the plane of the material.

It should be noted that such spring beams could also be stamped out of an inner contact body, although in this particular embodiment, due to the longitudinal spring, the inner contact body requires an outer spring body. Furthermore, such spring support members would also be usable with contacts having outer back-up springs whereby the inner contact body does not necessarily float therein, as reducing chattering would nevertheless reduce fretting corrosion. However, the combination of spring beams on the outer spring body, and the inner contact body with a supple longitudinal spring section is very advantageous for reducing fretting corrosion.

Advantageously therefore, the anti-chattering spring support members are simple to manufacture, yet provide a reliable and robust means of limiting chattering of a terminal within a corresponding housing cavity.

I claim:

1. An electrical terminal mountable in a cavity of a connector housing, the terminal comprising a connection section for electrical connection to a conductor, extending into a contact section for electrical connection to a complementary terminal, and a longitudinal box-shaped section positioned close to walls of the housing cavity when mounted therein, the box-shaped section comprising opposing top and bottom walls and opposing side walls extending between longitudinal lateral edges of the top and bottom walls, characterized in that the top and bottom walls comprise longitudinal spring beams joined at their ends to the walls, the beams comprising substantially centrally positioned protrusions extending beyond the side walls such that they resiliently interfere with the housing cavity walls for resilient support of the terminal therein to prevent chattering.

2. The terminal of claim 1 characterized in that the spring beams are edge-stamped and substantially comprised in the plane of the top and bottom walls.

3. The terminal of claim 1 characterized in that the top wall or bottom wall comprises a pair of opposed spring beams, each spring beam proximate the corresponding side wall.

4. The terminal of claim 1 characterized in that the spring beams are separated from the top and bottom walls by longitudinal slots in the plane of the walls.

5. The terminal of any preceding claim characterized in that the terminal comprises a separate outer spring body mounted over an inner contact body comprising the connection and contact sections, the outer spring body comprising the box-shaped section.

6. The terminal of claim 5 characterized in that the spring beams are positioned centrally between the base section and mating end of the contact section.

7. The terminal of claim 5 characterized in that inner contact body comprises a base section and a supple longitudinal spring section extending between the connection and contact section, whereby the outer spring body is securely attached to the inner contact body at the base section thereby allowing floating movement of the contact section within the outer spring body.

8. The terminal of claim 7 characterized in that the outer spring body extends longitudinally from the base section over the whole contact section for protecting the contact section therein.

* * * * *